United States Patent [19]
Barkan et al.
[11] 4,225,761
[45] Sep. 30, 1980

[54] ELECTRIC CIRCUIT BREAKER COMPRISING A PLURALITY OF VACUUM INTERRUPTERS SIMULTANEOUSLY OPERATED BY A COMMON OPERATOR

[75] Inventors: Philip Barkan, Stanford, Calif.; Imdad Imam, Secane, Pa.

[73] Assignee: General Electric Company, Philadelphia, Pa.

[21] Appl. No.: 841,429

[22] Filed: Oct. 12, 1977

[51] Int. Cl.[2] ..... H01H 33/66
[52] U.S. Cl. ..... 200/144 B; 200/145
[58] Field of Search ..... 200/144 B, 145, 148 F, 200/144 R

[56] References Cited

U.S. PATENT DOCUMENTS

| | | | |
|---|---|---|---|
| 1,920,894 | 8/1933 | Ruppel | 200/148 F |
| 2,981,814 | 4/1961 | Friedrich | 200/145 |
| 3,300,609 | 1/1967 | Flurscheim et al. | 200/144 B |
| 3,527,910 | 9/1970 | Mitchell, Jr. et al. | 200/144 B |

*Primary Examiner*—Robert S. Macon
*Attorney, Agent, or Firm*—William Freedman

[57] ABSTRACT

This circuit breaker comprises a plurality of a vacuum-type circuit interrupters, each having a movable contact rod. A common operating device for the interrupters comprises a linearly-movable operating member. The interrupters are mounted at one side of the operating member with their movable contact rods extending in a direction generally toward the operating member. Means is provided for mechanically coupling the operating member to the contact rods, and this means comprises a plurality of insulating operating rods, each connected at one end to the operating member and at its opposite end to one of the movable contact rods. The operating rods are of substantially equal length and have longitudinal axes that converge and intersect at substantially a common point.

14 Claims, 6 Drawing Figures

ELECTRIC CIRCUIT BREAKER COMPRISING A PLURALITY OF VACUUM INTERRUPTERS SIMULTANEOUSLY OPERATED BY A COMMON OPERATOR

The Government of the United States of America has rights in this invention pursuant to Contract No. Ex-76-C-01-2065 awarded by the U.S. Energy Research and Development Administration.

BACKGROUND

This invention relates to a vacuum-type electric circuit breaker comprising a plurality of vacuum-type circuit interrupters which are operated substantially simultaneously during circuit-breaker operation and, more particularly, relates to a circuit breaker of this type that employs a common mechanical operator at ground potential for operating the interrupters.

A typical circuit breaker of this type is shown in U.S Pat. No. 3,839,612—Badey et al, assigned to the assignee of the present invention. In this circuit breaker the interrupters are electrically connected in series in order to enable the circuit breaker to handle the required high voltages. Substantially simultaneous operation of the interrupters is required in order to effect the desired uniformity of voltage distribution between the interrupters during operation. In this respect, the contacts of all the interrupters should part within a predetermined maximum time period during an opening operation, e.g., ½ to 1 millisecond, and should engage during a predetermined maximum interval during a closing operation, e.g., 1 to 2 milliseconds.

For effecting such substantially simultaneous operation, the interrupters are connected to a common operator at ground potential through operating rod structure which comprises a plurality of insulating rods mechanically connected in series. In this type of arrangement, it is difficult to limit to the desired extent the timing variations between the interrupters because of the differences in the stiffness of the couplings between the common operator and the respective interrupters.

SUMMARY

An object of our invention is to provide, for a multiple-interrupter circuit breaker having a common operator for the interrupters, an operating arrangement that is highly effective in limiting variations in operating times between the interrupters.

Another object is to provide for such a circuit breaker an operating arrangement in which the couplings between the respective interrupters and the common operator have stiffnesses that are substantially equal.

Another object is to provide for such a circuit breaker an operating arrangement in which the couplings between the respective interrupters and the common operator have natural frequencies that are substantially equal.

In a circuit breaker such as that of the Badey et al patent, certain of the interrupters are relatively remote from the common operator, and thus the interconnecting linkage between such interrupters and the operator must be quite long if constructed as in the Badey et al patent. Such an interconnecting linkage because of its relatively great length has a rather large amount of yield. This diminishes the ability of the operator to produce opening of the remote interrupters with a minimum time delay and at the desired high speed.

Another object of our invention is to provide, for a multiple-interrupter circuit breaker having a common operator for the interrupters, an operating arrangement that is capable of responding in an extremely short time to initiate high speed opening operation of all the interrupters. That is, we seek to substantially minimize the time delay between the imposition of an electrical control signal and the beginning of contact motion.

Another disadvantage of the arrangement of the Badey et al patent is that as the number of interrupters is increased (by adding interrupters more remote from the operator), the effective stiffness of the coupling to the added interrupters decreases, further reducing the ability of the mechanism to provide simultaneous operation of the interrupters and to produce rapid response, high speed operation of the more remote interrupters.

Another object is to provide an arrangement in which the number of interrupters can be increased without reducing the effective stiffness of the coupling between the added interrupters and the common operator.

In carrying out our invention in one form, we provide a circuit breaker that comprises a plurality of vacuum-type circuit interrupters, each comprising a first contact, a second contact movable into and out of engagement with the first contact, and a movable contact rod on which the second contact is mounted. A common operating device, at substantially ground potential for the interrupters is provided and comprises a linearly-movable operating member movable during a circuit-breaker opening stroke along a predetermined reference axis. The interrupters are mounted at one side of the operating member with their movable contact rods extending in a direction generally toward the operating member. The operating member is mechanically coupled to the movable contact rods by means comprising a plurality of operating rods primarily of insulating material. Each operating rod is connected at one end to the operating member and at its opposite end to one of the movable contact rods. The operating rods are of substantially equal length and equal stiffness and have longitudinal axes that converge and intersect at substantially a common point.

BRIEF DESCRIPTION OF DRAWINGS

For a better understanding of the invention, reference may be had to the accompanying drawings in which.

DETAILED DESCRIPTION OF PREFERRED EMBODIMENT

Figure 1:
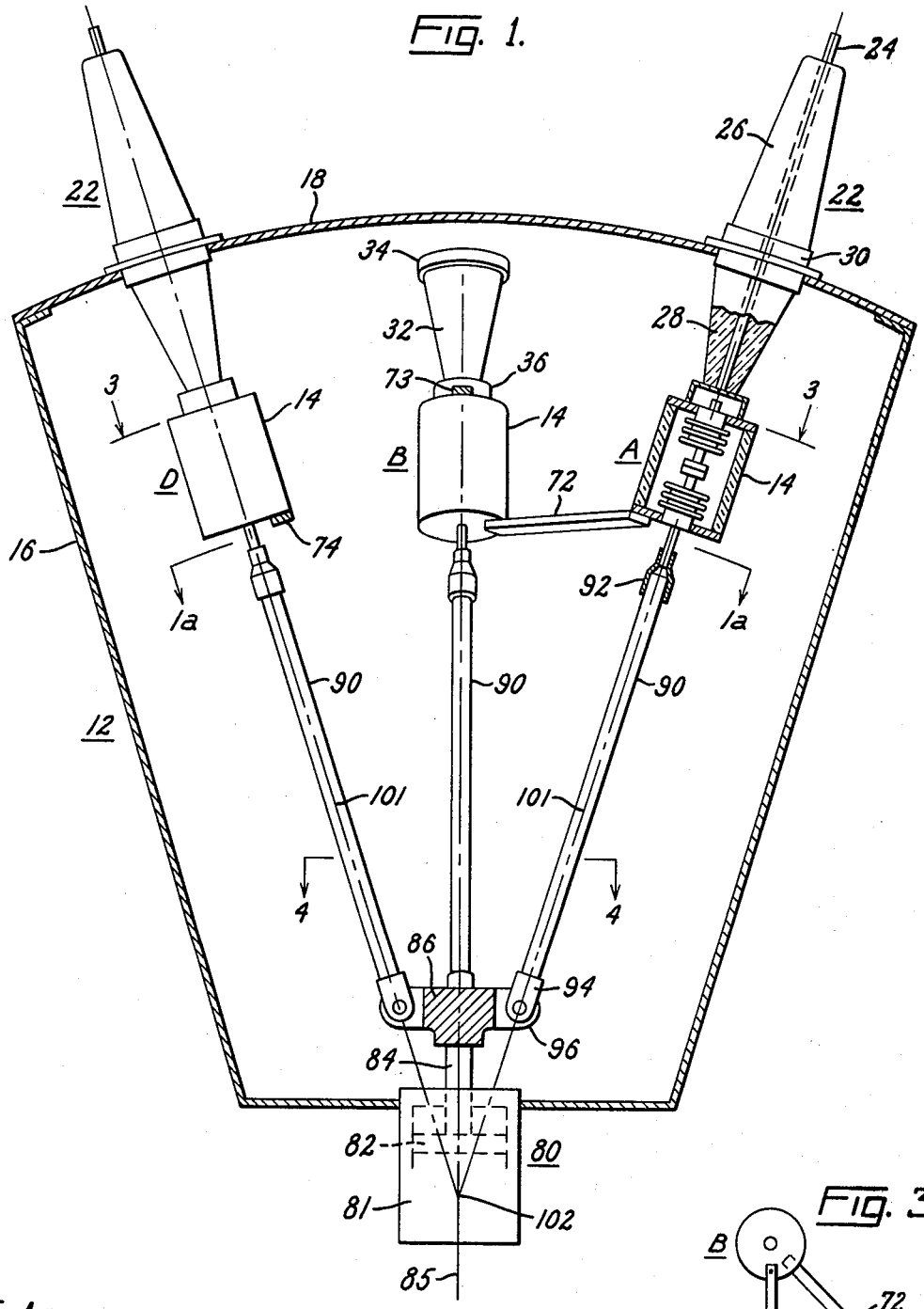
FIG. 1 is a side elevational view partially in cross-section showing a circuit breaker embodying one form of the invention.

Referring now to FIG. 1, the circuit breaker shown therein comprises a metal tank 12 at ground potential and a plurality of vacuum interrupters 14 located within the tank. In the illustrated circuit breaker, and by way of example and not limitation, four interrupters are shown within the tank. The illustrated tank comprises a truncated conical body portion 16 having a vertically extending central axis and a dished head 18 mounted atop the body portion and suitably secured thereto, as by a bolted flange connection (not shown). The bottom of the tank is defined by a plate 20 welded to the lower end of body portion 16.

Extending through the head 18 are two high voltage terminal bushings 22, each of a conventional construction. Each bushing comprises a rigid central conductor 24 and a housing surrounding the central conductor comprising two tubular shells 26 and 28 of porcelain and a tubular mid-section 30 of metal disposed between the porcelain shells and suitably fixed to the head 18. The two bushings are disposed so that their longitudinal axes converge and intersect near the bottom of the tank. At the inner end of each bushing 22, one of the interrupters 14 is mounted in a manner soon to be described.

The remaining two interrupters are mounted on the head 18 by means of post-type insulators 32. Each of these insulators has a metal flange at its upper end suitably fixed to the head 18 and a metal adaptor 36 at its lower end for mounting the associated interrupter 14 thereon.

Figure 2:
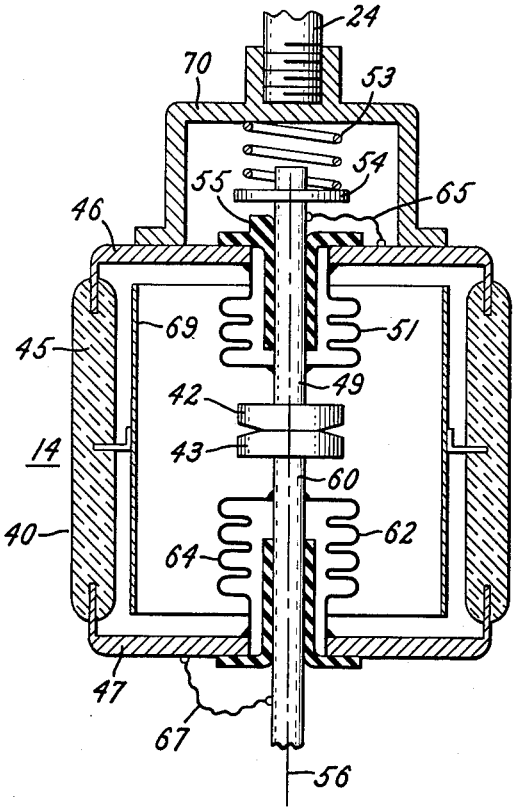
FIG. 2 is an enlarged sectional view of one of the interrupters present in the circuit breaker of FIG. 1.

Referring to FIG. 2, each of the vacuum interrupters 14 is of a conventional design. As such, it comprises a highly evacuated envelope 40 and a pair of separable contacts 42 and 43 within the envelope. The envelope comprises a tubular casing 45 of insulating material having a central longitudinal axis 56 and metal end caps 46 and 47 suitably sealed to the casing at its opposite ends. Upper contact 42 is a contact capable of a small amount of axial movement, referred to hereinafter as wipe travel. This contact 42 is mounted on a conductive contact rod 49 that extends freely through upper end cap 46 in sealed relationship thereto. The seal is provided by a metal bellows 51 joined at its respective opposite ends to the end cap 46 and the contact rod 49. A suitable tubular guide 52 mounted on the upper end cap 46 guides the rod 49 along a straight line path during its wipe travel. A compression-type wipe spring 53 acting at its lower end against a shoulder 54 on contact rod biases the contact rod 49 in a downward direction. The upper end of the wipe spring bears against a stationary member 70 soon to be described. When the circuit breaker is closed, the contacts 42 and 43 engage each other and are held in engagement by hold-closed force supplied by wipe spring 53.

The lower contact 43 is a movable contact fixed to the upper end of a movable contact rod 60 that extends freely through the lower end cap 47. A flexible metal bellows 62 joined at its respective opposite ends to the movable contact rod 60 and end cap 47 provides a seal about the movable contact rod and allows for reciprocation of the movable contact rod without impairing the vacuum inside the envelope. A suitable sleeve bearing 64 fixed to end cap 47 surrounds the movable contact rod 60 and acts to guide the contact rod 60 in a substantially straight line path during opening and closing motion thereof.

The current path through the interrupter when the interrupter is closed extends from the upper end cap 46 to the contact rod 49 via a suitable flexible conductor 65, then through contacts 42, 43, and movable contact rod 60, and then through a suitable flexible conductor 67 to the lower end cap 47.

Opening of the interrupter is effected by driving movable contact rod 60 downwardly to separate the contacts. During the initial part of the opening operation, the upper contact 42 moves downwardly with the lower contact 43, being driven in downward follow-up relationship by the wipe spring 53. But after a short amount of such downward wipe travel, the shoulder 54 on contact rod 49 encounters a stationary stop 55, thereby terminating downward motion of contact 42 and allowing the downwardly moving lower contact to rapidly separate therefrom. This establishes an arc between the contacts, which arc is extinguished in a known manner at an early current zero in the case of an a-c circuit. For condensing the arcing products, a tubular metal shield 69 surrounds the contacts in spaced relationship within the envelope. This shield 69 is preferably electrically isolated from both contacts when the interrupter is open.

Closing of the interrupter is effected by driving the movable contact rod 60 upwardly from its open position to reengage the contacts 42 and 43. Such upward closing motion of contact 43 continues for a short distance (referred to as wipe travel) following initial contact-engagement, and this wipe travel drives the upper contact 42 upwardly, compressing the wipe spring 53, and returning the parts to the position of FIG. 1.

For supporting each of the interrupters 14 from the lower end of its supporting insulator (i.e., the bushing 22 or the post insulator 32, as the case may be), a bracket 70 of U-shaped cross section is provided. This bracket is attached at its lower end to the upper end cap 46 of the interrupter and at its upper end to the bushing stud 24 in the case of a bushing 22 or to a corresponding part (not shown) in the case of a post insulator 32. This bracket 70 provides a conductive path between the bushing stud 24 and the upper end cap 46 of the interrupter in the case of the two interrupters that are mounted on the bushings.

Figure 3:
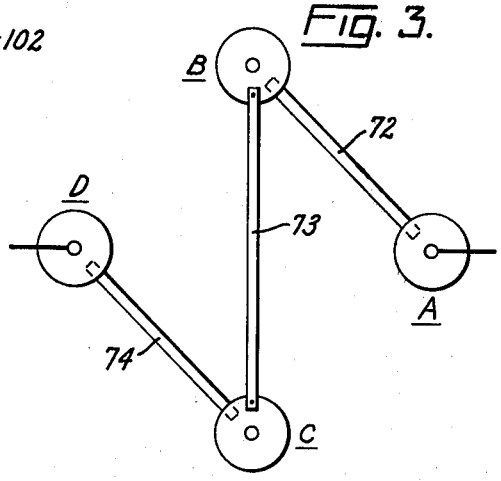
FIG. 3 is a simplified sectional view as seen from a spherical section depicted by the line 3—3 of FIG. 1.

The contacts of the four interrupters are electrically connected in series by means of conductors 72, 73 and 74 extending between the interrupters as best shown in FIG. 3. Conductor 72 extends between the lower end caps 47 of two of the interrupters A and B. Conductor 73 extends between the upper end caps of the two interrupters B and C mounted on post insulators 32; and conductor 74 extends between the lower end caps of the two interrupters C and D.

Figure 1A:
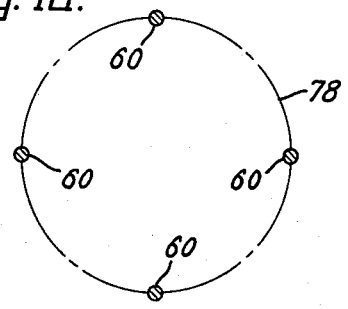
FIG. 1*a* is a simplified sectional view taken along the line 1*a*—1*a* of FIG. 1.

As will be apparent from FIGS. 1, 1*a* and 3 the interrupters 14 are mounted in a generally circular pattern. Referring to FIG. 1*a*, the interrupters may be thought of as being so located that their movable contact rod 60 are located at points circumferentially spaced by equal amounts along a predetermined reference circle 78. This reference circle 78 will be referred to in more detail hereinafter.

The four interrupters are operated by means of a single common operator 80 located near the bottom of the tank 12 and at ground potential. In a preferred form of the invention, this operator 80 comprises a fluid motor that includes a cylinder 81 and piston 82 vertically slidable therein. The operator 80 further comprises the vertically-extending piston rod 84 of the piston and a cross-head 86 fixed to the piston rod at its upper end. The subassembly 82, 84, 86 is linearly-movable along a straight-line vertical path 85 referred to hereinafter as a reference axis. This reference axis coincides with the central longitudinal axis of piston rod 84 and also the central axis of the reference circuit 78 of FIG. 1*a* and extends perpendicular to the plane of said reference circle. The fluid motor can be of any suitable type capable of rapid response to a starting signal, but it is preferably of the type shown and claimed in our copending application Ser. No. 810,663, filed on June 27, 1977.

The invention in its broader aspects comprehends the use of other types of motors, such as a high-speed spring motor (not shown), operation of which is initiated by tripping a suitable latch that, when tripped, allows the spring to rapidly discharge.

Figure 4:
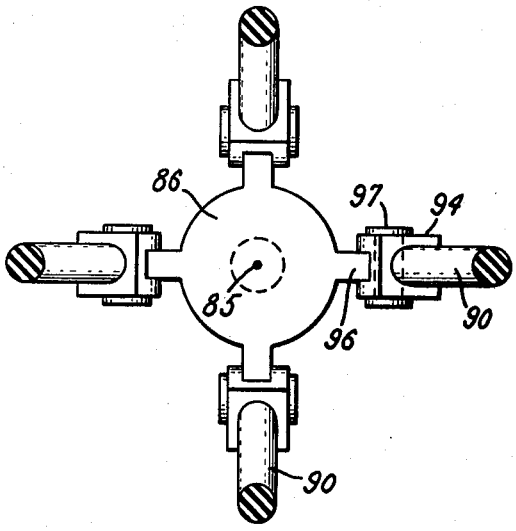
FIG. 4 is a sectional view taken along the line 4—4 of FIG. 1.

The cross-head 86, which is sometimes referred to herein as an operating member, is coupled to the movable contact rods 60 of the interrupters by means of operating rods 90 primarily of electrical insulating material. Each of these operating rods 90 has its upper end coupled to the lower end of one of the contact rods by a suitable sleeve coupling 92 of metal. As best shown in FIG. 4, the lower end of each operating rod 90 carries a yoke member 94 which receives a projecting lug 96 on the cross-head. A suitable pivot pin 97 pivotally interconnects parts 94 and 96. The four lugs 96 are circumferentially spaced by equal distances about the periphery of the cross-head.

As shown in FIG. 1, the longitudinal axes 101 of the operating rods 90 converge as the rods extend downwardly toward the operating member 86, intersecting at a point 102 on the central reference axis 85. The operating rods may be thought of as being located in regions spaced apart along the surface of the reference cone having the reference circle 78 as a base and the reference axis 85 as the logitudinal axis of the cone. The distances between the rods and the central axis 85 at any given plane parallel to the plane containing the base of the cone are substantially equal to the radius of the cone at said given plane.

Although I prefer to locate all the contact rods 60 on a predetermined reference circle (78), the invention in its broader aspects is not so limited. In its broader aspects, the invention is intended to comprehend an arrangement in which the interrupters, though not having their contact rods located on a reference circle, are all located at one side of the operating member 86, have their contact rods extending from the interrupters in a direction generally toward the operating member, and have their contact rods connected to the common operating member by operating rods that have longitudinal axes that converge and intersect at substantially a common point. The arrangement of FIG. 1 is clearly constructed in this manner since the interrupters are at the upper side of operating member 86 and have their contact rods directed toward the operating member, and the longitudinal axes 101 of operating rods 90 converge and intersect at a point 102.

The operating rods 90 are of equal length and have substantially equal stiffnesses and substantially equal masses. As a result of this relationship, the couplings between the respective movable contact rod 60 and the common operating member 86 have substantially the same natural frequencies; and, as will soon be discussed, this greatly facilitates effecting essentially simultaneous separation of the contacts of the four interrupters during an opening operation and essentially simultaneous engagement of these contacts during a closing operation. This is in distinct contrast to an arrangement such as shown in the aforesaid Badey et al patent where the couplings to the different interrupters are primarily connected in series and thus have greatly different lengths, greatly different stiffnesses, and greatly different masses.

The mechanically-parallel relationship of the operating rods 90 contributes to a relatively high natural frequency for the overall linkage comprising the four operating rods 90. In this respect, with the four rods connected in parallel, the effective stiffness of the system is 4K, where K is the stiffness of each rod-type coupling. But where the linkages are connected in series, as in the Badey et al patent, the effective stiffness of the system (assuming the system comprises four series-connected portions each with a stiffness K) is K/4. Thus, in the compared examples, the stiffness of the parallel-coupled system is about 16 times that of the series-coupled system. Assuming that both systems have the same effective mass, this 16 fold greater stiffness will result in a system natural system frequency 4 times greater. This will be apparent from the fact that the natural frequency $f_n$ of the system is proportional to: $\sqrt{K/m}$, where K is the effective stiffness of the system and m is the effective mass of the system.

This higher natural frequency for the system has a number of significant advantages. First, the response time of the system is reduced since this response time is inversely proportional to the system natural frequency. By response time is meant the time needed to transmit a force from the driving to the driven end of the system. Second, the higher natural frequency results in a system less likely to resonate at earthquake frequencies, thus reducing the chance for damage by an earthquake. Third, the higher natural frequency facilitates stopping the system at the end of an operating stroke since there is less tendency of a higher natural frequency system to oscillate in an undesirable manner when abruptly stopped. In addition, the higher natural frequency makes it easier to decelerate the system without exceeding the bounds of allowable travel.

Since, as noted above, the response time of a linkage is a function of its natural frequency, it will be apparent that by providing linkages between the common operator and the four interrupters that individually have about the same natural frequency and the same resultant response time, we have greatly facilitated the achievement of substantially simultaneous separation of the interrupter contacts during an opening operation of the circuit breaker. This feature also facilitates substantially simultaneous engagement of the contacts during a closing operation.

In certain circuit breakers it is essential that the interrupters be operated with very short response times and at very high speed. Our circuit breaker lends itself exceptionally well to such duty because the linkage between each interrupter and the operator is very short and has a high stiffness, both of which contribute to the high natural frequency needed for the short response time and high speed operation. In the aforesaid Badey et al patent, the linkage to the remote interrupters is relatively long and has a relatively low stiffness, thus making it very difficult to operate the remote interrupters through such linkage in a very short time. With respect to length of the linkage, it will be noted that in our arrangement, the linkage to each interrupter is virtually a minimum length (consistent with electrical insulation requirements). Almost all of the length present in our linkage is needed for insulation between the interrupter and ground, and virtually none results from the need for insulation between the interrupters, which is clearly not the case in the linkage of the Badey et al patent. With respect to stiffness of the linkage, in the Badey et al patent the relatively long linkage to the remote interrupters has a relatively low stiffness since the effective stiffness of this linkage is reduced by the yield in its many series-connected components, including those located between the interrupters. But in our arrangement there is very little yield in the short, simple rod-type linkage between the operating member 86 and each individual interrupter, which linkage is devoid of components connected between the interrupters.

The conical arrangement of the operating rods contributes significantly to the ability to achieve exceptionally short response times and high speeds because such arrangement results in the linkage between the common piston rod 84 and each interrupter contact rod 60 being of esentially minimum length for a given length of electrical insulation as represented by the insulating portion of the operating rod. If, instead of the conically-arranged rods, vertically-extending operating rods of the same length were employed, the longitudinal axes of the operating rods at their lower ends would be located much further away from the central reference axis 85 than in the conical arrangement. This would necessitate using a much larger cross-head 86 to span the distance between the reference axis 85 and the axis of the assumed vertical operating rods. The net result would be a considerably more massive linkage between the piston rod 84 and each contact rod 60, thus reducing its natural frequency and its resultant response time.

Another feature contributing to the ability to achieve exceptionally short response time and high speed operation is the fact that the motor of the common operating device 80 is located immediately adjacent the cross-head 86. If the motor was remote from the cross-head, it would be necessary to provide a long intervening linkage, which would add effective mass and reduce effective stiffness, thus substantially reducing the response time.

In a preferred embodiment intended for short response time and high-speed operation, we directly couple the upper end of each operating rod to the contact rod of the interrupters without introducing any intervening force-changing or direction-changing components such as cranks or levers, and this contributes to added stiffness in the linkage between the operator and the interrupter. We are able to use this very simple coupling between the operating rod and the contact rod because we arrange the interrupter so that the central axis of its movable contact rod has its path of motion substantially colinear with the central axis of the operating rod and also because the interrupter is a vacuum interrupter, which type of interrupter characteristically has a very short stroke. The shortness of this stroke makes it possible for the operating member 86 to move along a path that is not precisely colinear with respect to the path of movement of the contact rod without developing much side thrust on the contact rod. Another feature contributing to the stiffness of the linkage is the fact that the wipe mechanism for each vacuum interrupter is disposed on its essentially stationary contact rather than in the force-transmitting path to the movable contact.

Where some reduction in operating speed is acceptable, we can in appropriate situations provide a suitable linkage between the upper end of the operating rod and the interrupter contact rod for force or direction-changing purposes. For example, referring to FIG. 5, there is shown a bell crank 110 pivotally mounted on a stationary pivot 112 and having one arm pivotally connected to the operating rod 90 and its other arm pivotally connected to the contact rod 60. In this embodiment, the path of motion of the contact rods is not substantially colinear with the axes 85 of the operating rods, but this is compensated for by the presence and operation of the bell crank 110.

Although FIG. 1 shows only a single interrupter (14) provided for each operating rod (90), and this is a much preferred arrangement where exceptionally short response times and high speeds are required, our invention in its broader aspects is intended to comprehend arrangements where a plurality of interrupters are operated by each operating rod. For example, a subassembly of two interrupters electrically in series, colinearly arranged in having their movable contact rods mechanically connected together and coupled to operating rod 90 could be substituted for each single interrupter in FIG. 1. Similarly, such a subassembly could be substituted for each single interrupter in the embodiment of FIG. 5.

Figure 5:
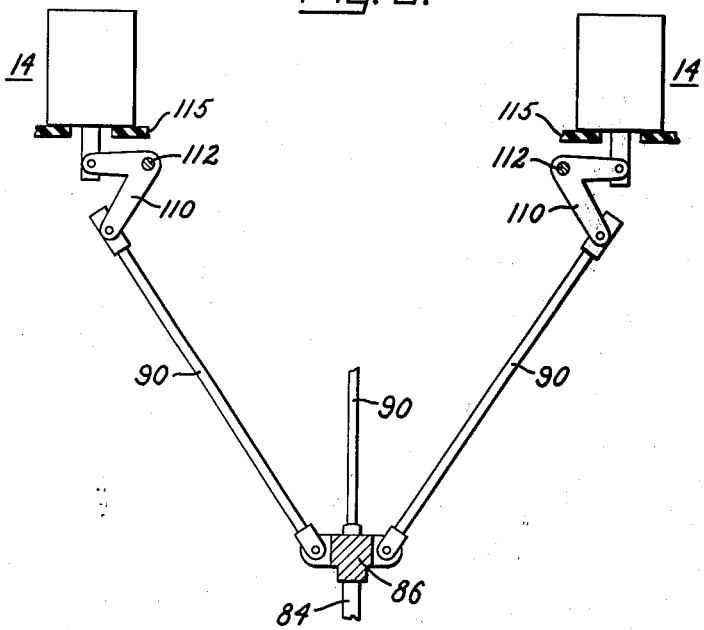
FIG. 5 is a simplified showing of a modified form of the invention.

Although FIG. 1 shows each of the interrupters 14 mounted on stationary support structure (36) attached to the interrupter at the generally stationary-contact end of the interrupter envelope, it is to be understood that the envelope can instead be suitably supported at its opposite, or movable-contact, end. A stationary support of this type is schematically shown in FIG. 5 at 115. In the general type of circuit breaker shown in FIG. 1, such a stationary support can be provided by relying upon a suitable insulating pedestal (not shown) extending from the bottom of the tank (16).

Although we illustrate each interrupter as being of a type that has its upper contact mounted for a slight amount of movement to provide for contact-wipe, it is to be understood that our invention in its broader aspects comprehends the use of interrupters having a stationary upper contact and a conventional wipe mechanism interconnecting the operating rod (90) and the contact rod (60) of each interrupter. Placing the wipe mechanism in this location reduces the stiffness of the coupling by a small amount, but this slight reduction can be tolerated in most applications, where a longer response time can be tolerated.

Although we have shown each of the joints between the crosshead 86 and the operating rods 90 as being a simple pivot joint comprising a cylindrical pivot pin received in a cylindrical bore, we can instead utilize a form of pivot joint such as a conventional ball bushing type which can allow for more misalignment between the adjacent parts. In such a ball bushing type joint the mating bearing surfaces are of a generally spherical configuration.

While we have shown and described particular embodiments of our invention, it will be obvious to those skilled in the art that various changes and modifications may be made without departing from the invention in its broader aspects; and we, therefore, intend herein to cover all such changes and modifications as fall within the true spirit and scope of the invention.

What we claim as new and desire to secure by Letters Patent of the United States is:

1. An electric circuit breaker comprising:

(a) a plurality of vacuum-type circuit interrupters, each comprising a first contact, a second contact movable into and out of engagement with said first contact, and a movable contact rod on which said second contact is mounted extending between the interior and the exterior of said interrupter, (b) an operating device at substantially ground potential for said interrupters comprising a substantially linearly-movable operating member movable during a circuit-breaker opening stroke along substantially a predetermined reference axis, (c) means for mounting said interrupters at one side of said operating member with their movable contact rods extending in a direction generally toward said operating member, (d) and means for mechanically coupling said operating member to said movable contact rods comprising a plurality of operating rods primarily of insulating material, each connected at one end to said operating member and at its opposite end to one of said movable contact rods, said operating rods being of substantially equal length and having longitudinal axes that converge and intersect at substantially a common point.

2. The circuit breaker of claim 1 in which said operating device comprises a motor at substantially ground potential, said motor comprising a fluid-operated piston located immediately adjacent said operating member and movable along substantially said predetermined reference axis.

3. The circuit breaker of claim 2 in which: said operating member comprises a cross-head coupled to said piston and the connection between said operating member and each insulating operating rod comprises means for pivotally connecting said operating rod to said cross-head.

4. The circuit breaker of claim 1 in which during circuit breaker operation each of said insulating operating rods is disposed substantially colinear with respect to the contact rod to which said operating rod is connected.

5. The circuit breaker of claim 1 in combination with means for electrically connecting the contacts of said interrupters in series with each other.

6. The circuit breaker of claim 2 in combination with means for electrically connecting the contacts of said interrupters in series with each other.

7. The circuit breaker of claim 1 in which all of said insulating operating rods are of substantially equal mass.

8. The circuit breaker of claim 1 in which all of said insulating operating rods are of substantially equal stiffness.

9. The circuit breaker of claim 1 in which the couplings between said operating member and the respective contact rods have substantially the same natural frequencies.

10. The circuit breaker of claim 1 in which:

(a) each of said interrupters is a vacuum-type circuit interrupter, (b) each of said insulating operating rods is disposed substantially colinear with respect to the contact rod to which said operating rod is connected, (c) means is provided for mounting said second contact of each interrupter so that it can move a limited distance with said first contact of said interrupter at the end of an interrupter-closing operation and at the start of an interrupter-opening operation, (d) means for biasing each of said second contacts toward its associated first contact to cause said second contacts to move with their associated first contacts during initial opening motion, and (e) stop means for blocking further motion of each of said second contacts with its associated first contact after a short amount of initial opening travel of said contacts together, thereby causing continued opening movement of said first contact to establish a gap between said first and second contacts.

11. An electric circuit breaker according to claim 1 in which each of said interrupters is so mounted that its contact rod is arranged to move along a path substantially colinear with the longitudinal axis of its associated insulating operating rod.

12. The circuit breaker of claim 1 in which said interrupters are mounted in a generally circular pattern with said contact rods being located at points circumferentially spaced-apart along a predetermined reference circle having its center substantially coinciding with said reference axis.

13. The circuit breaker of claim 1 in which the connection between each of said insulating operating rods and its associated movable contact rod comprises means for preventing substantial relative movement between said associated rods.

14. The circuit breaker of claim 11 in which the connection between each of said insulating operating rods and its associated movable contact rod comprises means for preventing substantial relative movement between said associated rods.

* * * * *